US006555964B1

(12) United States Patent
Huebner et al.

(10) Patent No.: US 6,555,964 B1
(45) Date of Patent: Apr. 29, 2003

(54) DEVICE, NOTABLY FOR CONTROLLING A TRAVELLING-WAVE TUBE

(75) Inventors: Karl-Heinz Huebner, Burgstetten (DE); Gerhard Reinwald, Aspach (DE); Abdel-Messiah Khilla, Backnang (DE); Hanspeter Katz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/380,959

(22) PCT Filed: Jan. 9, 1998

(86) PCT No.: PCT/DE98/00087

§ 371 (c)(1),
(2), (4) Date: Jan. 6, 2000

(87) PCT Pub. No.: WO98/40903

PCT Pub. Date: Sep. 17, 1998

(30) Foreign Application Priority Data

Mar. 12, 1997 (DE) ..... 197 10 100

(51) Int. Cl.[7] ..... H01P 25/34

(52) U.S. Cl. ..... 315/3.5; 330/43; 313/45; 313/46

(58) Field of Search ..... 315/3.5; 313/45, 313/46; 330/43

(56) References Cited

U.S. PATENT DOCUMENTS

| | | | | |
|---|---|---|---|---|
| 3,538,367 A | * | 11/1970 | Sarnezki et al. | 315/3.5 X |
| 3,593,059 A | * | 7/1971 | Sarnezki | 315/3.5 |
| 4,045,706 A | * | 8/1977 | Daffner et al. | 315/3.5 |
| 4,638,215 A | * | 1/1987 | Schmid et al. | 315/3.5 |
| 4,701,717 A | * | 10/1987 | Radermacher et al. | 330/43 X |
| 4,878,030 A | * | 10/1989 | Vincze | 330/43 X |
| 5,500,621 A | * | 3/1996 | Katz et al. | 315/3.5 X |

* cited by examiner

*Primary Examiner*—Benny T. Lee
(74) *Attorney, Agent, or Firm*—Kenyon & Kenyon

(57) ABSTRACT

A power-supply device and amplifier are joined by way of a mechanical/thermal interface to form a unit. Electrical connections between the power-supply device and the amplifier chamber are run within this shared unit. A shared electrical interface is provided for external control- and supply signals, respectively.

4 Claims, 4 Drawing Sheets

DEVICE, NOTABLY FOR CONTROLLING A TRAVELLING-WAVE TUBE

BACKGROUND INFORMATION

The present invention is based on an arrangement made up of a power-supply device and an amplifier.

The prospectus "Traveling-Wave Tube Amplifiers (TWTAs) for Space-Application" ANT 776 841, March 1992, of the firm ANT Nachrichtentechnik GmbH describes a power-supply device for a traveling wave tube amplifier. An amplifier and a linearizer are provided with voltage from this power supply. The power-supply device and amplifier, as well as the linearizer are accommodated in independent individual units which are not adjusted to one another.

"ANT Nachrichtentechnische Berichte", issue Feb. 8, 1991, pp. 31 through 40, describes a microwave power amplifier for driving a traveling-wave tube. The power amplifier, linearizer and power supply (EPC) are independent individual units in this case. Protective circuits for overload or for too low an input voltage are accommodated in the power-supply device. In each case, the microwave subassemblies of the power amplifier are accommodated in a housing half-member, separate from the control circuit.

SUMMARY OF THE INVENTION

The measures of the present invention make it possible to attain an arrangement, in particular for driving a traveling-wave tube, which is non-critical with regard to electromagnetic compatibility (EMV). Costly wiring and cabling between individual units, which can negatively influence the electromagnetic compatibility, are not necessary. In particular, it is not necessary to provide numerous long connections for d.c. low voltages, d.c. high voltages, control signals and high-frequency signals between individual units.

Due to the compact design, no individual units need to be separately specified. Also, safety allowances are minimized as opposed to individual units. One input/output specification can be created for the entire assembly, which simplifies the drawing-up of a specification.

There is a reduction in weight and installation area compared to individual units, which is particularly advantageous for applications in satellites.

The structural uniting of the power-supply device, the amplifier, and an optionally provided linearizer eliminates the additional design margins previously included in the designs of previous individual units, reduces the number of amplifier modules, as well as previously necessary attenuator modules.

DETAILED DESCRIPTION

Figure 1:
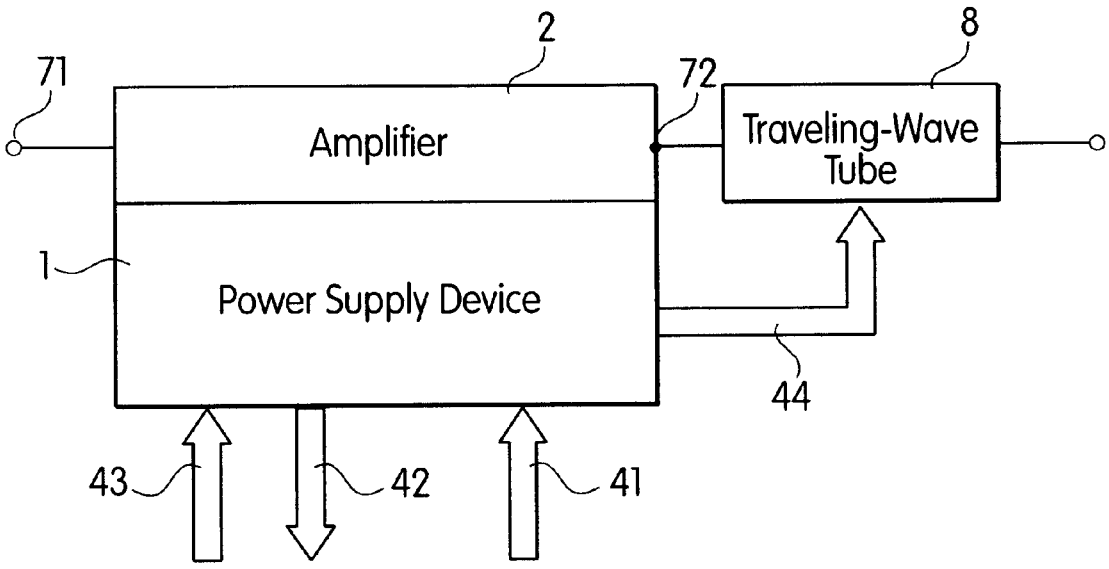
FIG. 1 shows a synoptic block diagram of an arrangement according to the present invention.

FIG. 1 shows a synoptic block diagram of an arrangement according to the invention. A power-supply device 1 is joined to an amplifier 2 to form a unit. The supply-, control- and, optionally, monitor signals for amplifier 2 and power-supply device 1 are supplied and carried away via shared electrical interfaces 41, 42, 43. The control signals are, for example, telecommand signals for controlling the amplifier 2 which are supplied via interface 41. The signals necessary for the status telemetering, such as the amplifier output power and/or helix voltage, helix current, are carried via interface 42. Interface 43 is provided for feeding the supply voltage. The high-frequency input signal for the amplifier 2 is supplied via input 71. The high-frequency output signal is conducted via output 72 to traveling-wave tube 8. The supply voltages of traveling-wave tube 8 (anode voltage, cathode voltage, heater voltage, helix voltage, collector voltages) conditioned in power-supply device 1 are supplied via connection 44.

Figure 2:
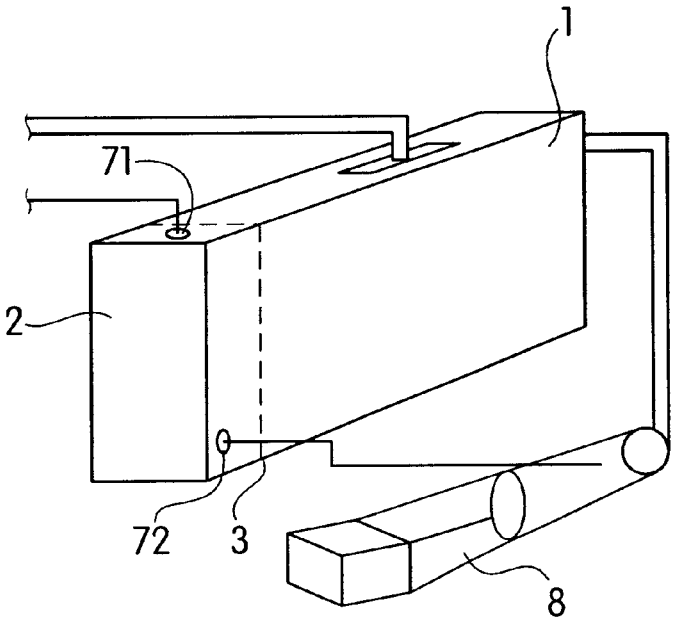
FIG. 2 shows the mechanical interface between the power-supply device and the amplifier.

FIG. 2 shows mechanical interface 3 (dotted line) between amplifier 2 and power-supply device 1. The housings, which are screened all-round, of power-supply device 1 and amplifier 2 are firmly interconnected mechanically via this interface 3. This connection is effected on a shared exterior of power-supply device 1 and amplifier 2. Since the type of construction of amplifier 2 is adapted to the type of construction of power-supply device 1 for a flat joining, (upper side or lower side of a cuboid having identical surface area), good thermal coupling also results, so that one input/output specification can be drawn up for the entire device. This implementation also permits a reduction of installation area on a satellite platform, for example, since amplifier 2 does not have to be mounted extra on the platform, but rather is merely added like a story onto power-supply device 1.

Figure 3:
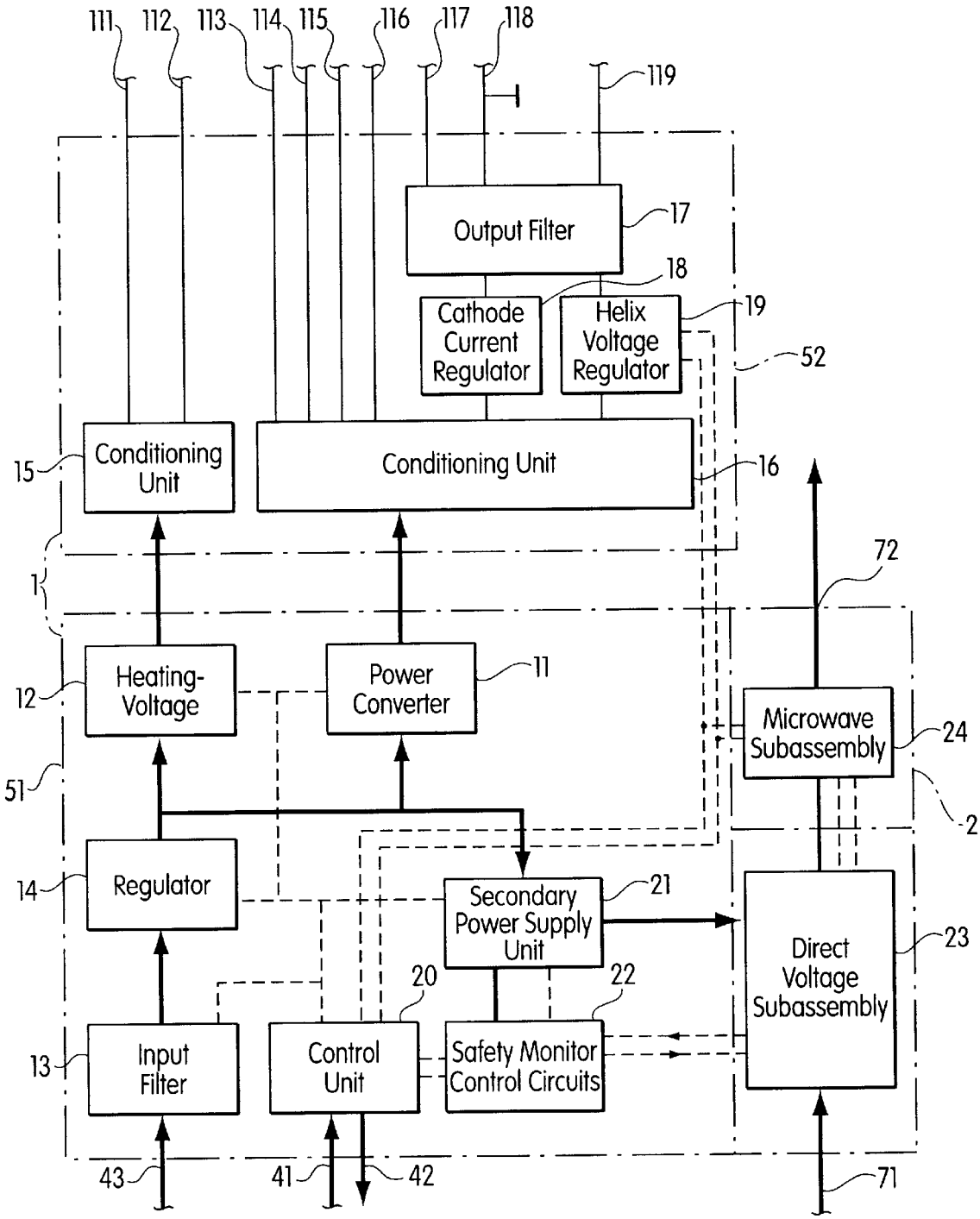
FIG. 3 shows a block diagram of the subassemblies according to FIG. 1.

The block diagram according to FIG. 3 shows the individual subassemblies of power-supply device 1. Provision is made for a module 51, on which are included the low-voltage-side subassemblies of power-supply device 1, as well as the control-signal conditioning and supply-voltage conditioning for amplifier 2. A module 52 is provided for the high-voltage conditioning. Located on module 51 are power converter 11 and heating-voltage transformer 12 which, via an input filter 13 having starting regulator and a pre-regulator 14, are able to receive the main-bus supply voltage of a satellite by way of input 43. A secondary power-supply unit 21 for amplifier 2 is also connected to the output of pre-regulator 14. Safety-, monitoring- and control circuits, combined in block 22, for amplifier 2 are likewise located in module 51 of power-supply device 1. Module 52 for the high-voltage subassemblies has a conditioning unit 1 5 for the heating voltage (outputs 111, 112) and a conditioning unit 16 for the high voltages of traveling-wave tube 8. These high-voltage conditioning units furnish the collector voltages (outputs 113, 114, 115, 116), the cathode voltage which is adapted to be tapped off via an output filter 17 at output 117, the anode voltage which is conducted via a cathode current regulator 18 and the output filter to output 118, as well as the helix voltage which is conducted via helix voltage regulator 19 and output filter 17 to output 119. Control unit 20 is used for processing the digital signals supplied and carried away via interfaces 41 and 42. As the dotted lines of action show, the helix current and the helix voltage, as well as the amplifier output power are monitored in particular, and analog control signals for amplifier 2 are conditioned via block 22.

Amplifier 2, whose housing is coupled mechanically and thermally via interface 3 to power-supply unit 1, includes a direct-voltage subassembly 23 and a microwave subassembly 24.

In FIG. 3, the power signals supplied from outside are indicated by thick, uninterrupted lines having corresponding arrows. Within power-supply unit 1, connections which carry the direct-voltage signals are represented by uninterrupted, thinner lines. Broken lines of action are provided for analog control signals, and dotted lines of action are provided for digital signals.

Figure 4:
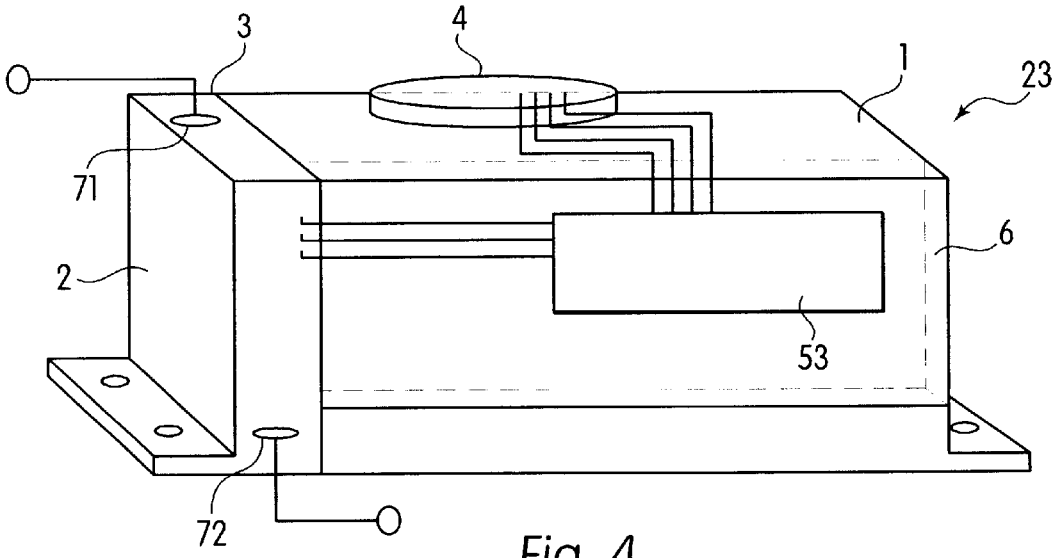
FIG. 4 shows the integration of he amplifier with the power-supply device.

As FIG. 4 shows, direct-voltage subassembly 23 for amplifier 2 is preferably accommodated on a printed circuit board 53 or in a module, separate from microwave subassembly 24 (not shown in FIG. 4; see FIG. 3), in an enclosed, screened chamber 6 of the housing of power-supply device 1. The housing of amplifier 2 is firmly joined on the left narrow side of the housing of power-supply device 1 to said housing, to form a unit. A shared electrical interface 4 in the form of a plug receptacle on the top side of the housing for power-supply device 1 is provided for external control- and supply signals of power-supply device 1 and of amplifier 2. All the electrical connections between power-supply device 1 and amplifier 2 are run within the shared unit. These require only short lines and reduce EMV problems considerably. External wiring and cabling are limited to the minimum of a single electrical interface.

Figure 5:
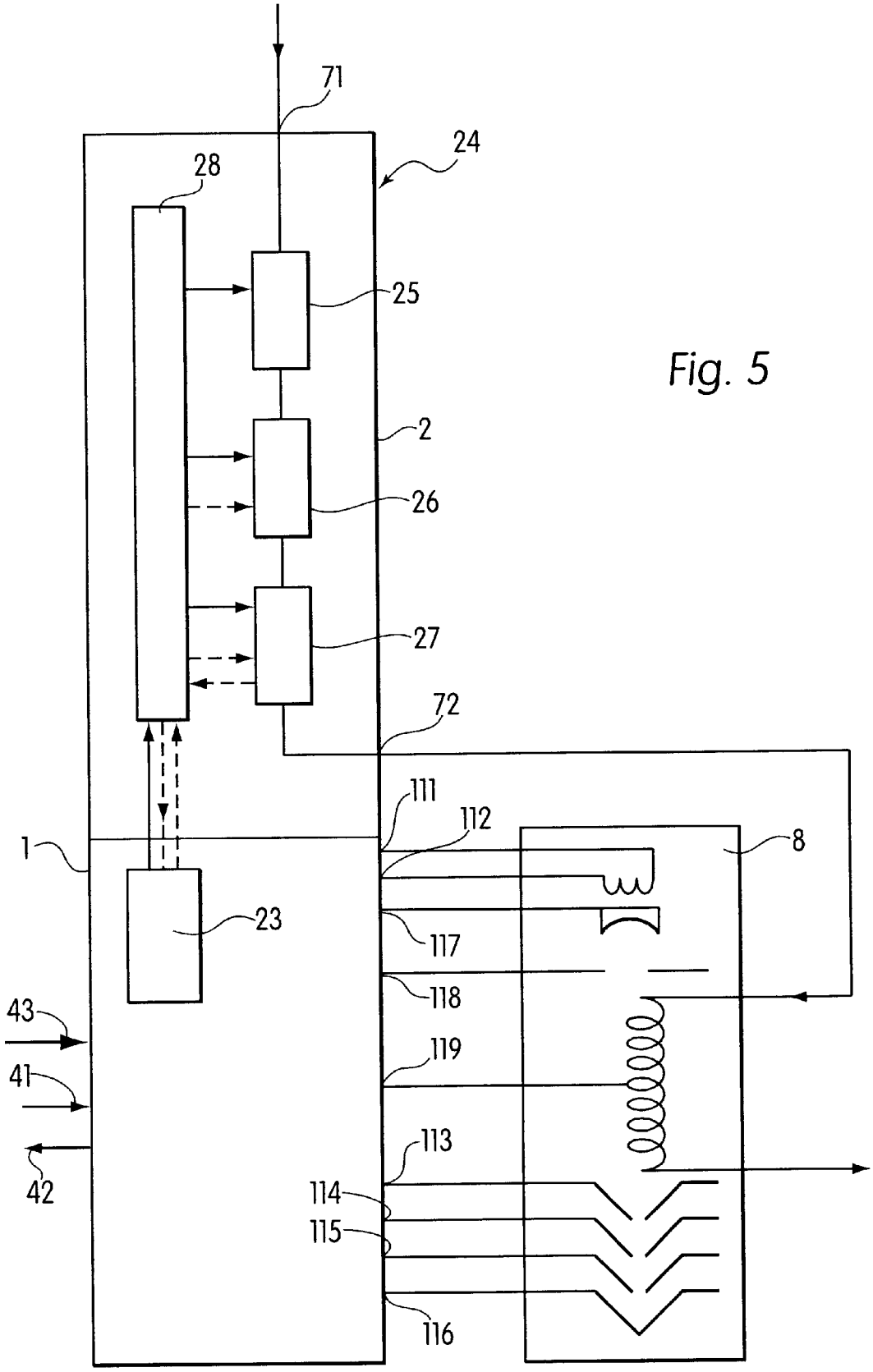
FIG. 5 shows an overview of the subassemblies in a channel amplifier.

FIG. 5 shows the individual subassemblies of amplifier 2, which here is constructed as an integrated, linearized channel amplifier. This design saves a separate linearizer having the previously described disadvantages. Microwave subassembly 24 is composed of the chain connection of a pre-amplifier 25, a linearizer stage 26 and an output amplifier 27. Linearizer stage 26 can be constructed, according to ANT Communication-Engineering Reports, issue Feb. 8, 1991, pp. 38 and 39, as a linearizer bridge. The supply voltages furnished by direct-voltage subassembly 23, as well as the analog control signals, are carried via bus unit 28 to the individual microwave circuits. FIG. 5 also shows the wiring of traveling-wave tube 8. The output 72 of amplifier 2 is connected to the helix of traveling-wave tube 8. The supply voltages for the traveling-wave tube are conducted via outputs 111, 112, 113, 114, 115, 116, 117, 118, 119 of the power-supply device 1.

Figure 6:
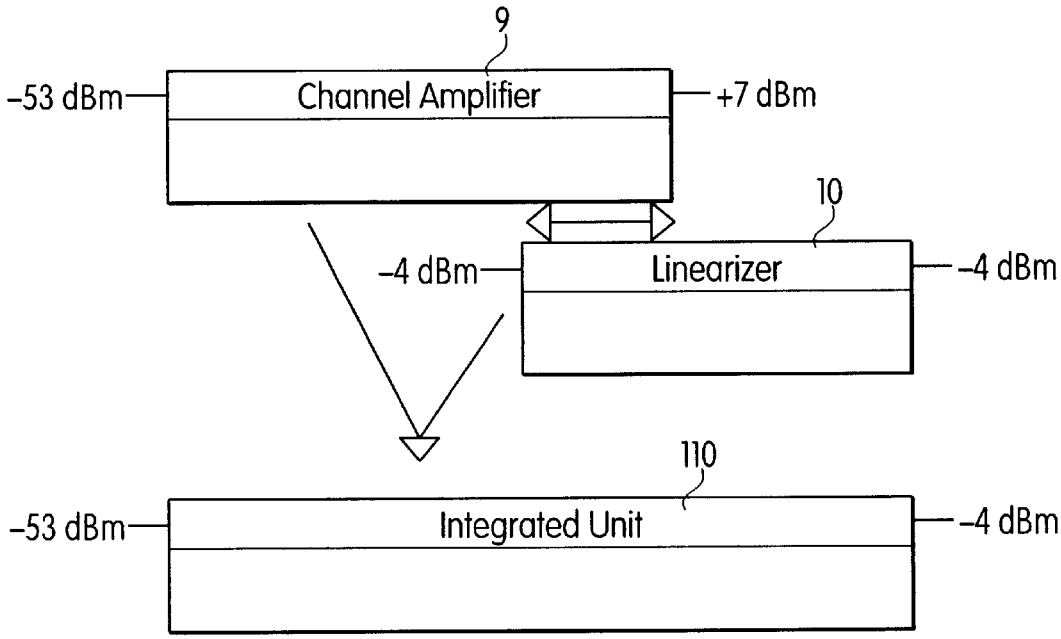
FIG. 6 shows level relationships for previous arrangements, as well as for the arrangement of the present invention.

FIG. 6 shows the level relationships for previous individual devices for driving a traveling-wave tube in comparison to the integrated unit of the present invention. Although the input power of a traveling-wave tube is approximately −4 to −8 dBm, the output power of an amplifier for driving the traveling-wave tube is specified up to +7 dBm. That is 15 dB more than necessary, which requires additional amplifier modules in such a conventional channel amplifier 9. Linearizer 10 has an input and output power of approximately −4 dBm (gain=0 dB). If the three devices—channel amplifier 9, linearizer 10 and traveling-wave tube 8—are cascaded one after the other, provision must be made for an additional attenuator between channel amplifier 9 and linearizer 10. In the integrating unit 110 of the present invention, the overlap of input and output power requirements and associated safety allowances are eliminated, as shown at in FIG. 6, wherein the overlapping range requirements of −53 dBm to +7 dBm of channel amplifier 9 and −4 dBm to −4 dBm of linearizer 10 are replaced by the −53 dBm to −4 dBm range associated integrating unit 110. Further, the number of amplifier modules and attenuator modules is reduced in each case by at least one module. The respective unmarked lower units in FIG. 6 stand for the power supply- and control subassemblies.

What is claimed is:

1. An arrangement for driving a traveling-wave tube, comprising:

a power-supply device for use with the traveling-wave tube;

a first housing for accommodating the power-supply device;

an amplifier for providing microwave signals and including:

a plurality of electrical connections with the power-supply device, and a plurality of microwave subassemblies, wherein said subassemblies include a pre-amplifier, a linearizer stage and an output amplifier;

a second housing for accommodating the amplifier;

a mechanical/thermal interface through which the first housing and the second housing are firmly joined to form a unit and through which the plurality of electrical connections run;

at least one shared electrical interface for respectively providing external control signals and supply signals between the power-supply device and the amplifier; and a control-signal and supply-voltage conditioning unit for the amplifier, the control-signal and supply-voltage conditioning unit being arranged separately from the plurality of microwave subassemblies in the second housing.

2. The arrangement according to claim 1, wherein the first housing and the second housing are respectively enclosed.

3. The arrangement according to claim 1, wherein:

the mechanical/thermal interface is arranged to facilitate joining of an exterior of the second housing of the amplifier to an exterior of the first housing of the power-supply device where the first housing and second housing smoothly abut each other, and a construction of the amplifier is adapted to mechanically interconnect to a construction of the first housing of the power-supply device.

4. The arrangement according to claim 1, further comprising:

a device including one of a printed circuit board and a module arranged in an enclosed chamber of the first housing and on which is provided the control-signal and supply-voltage conditioning unit.

* * * * *

UNITED STATES PATENT AND TRADEMARK OFFICE

CERTIFICATE OF CORRECTION

PATENT NO. : 6,555,964 B1
DATED : April 29, 2003
INVENTOR(S) : Karl-Heinz Huebner et al.

It is certified that error appears in the above-identified patent and that said Letters Patent is hereby corrected as shown below:

Column 1,
Line 53, insert -- Exemplary embodiments of the invention shall be described in greater detail with reference to the drawings. The same reference number used in multiple figures refers to the same feature in each figure, and the reference number may not be described in detail for all the figures. --

Signed and Sealed this

Fourth Day of May, 2004

JON W. DUDAS
*Acting Director of the United States Patent and Trademark Office*